US008459644B1

(12) United States Patent
Thompson et al.

(10) Patent No.: US 8,459,644 B1
(45) Date of Patent: Jun. 11, 2013

(54) DEVICE AND METHOD FOR HIGH-SPEED MEDIA INVERSION USING A DUAL PATH, SINGLE REVERSING ROLL INVERTER

(75) Inventors: Bruce Allen Thompson, Fairport, NY (US); Frank Albert Porter, Penfield, NY (US); Michael J. Linder, Walworth, NY (US); William Matthew Harney, Rush, NY (US); Robert J. Rinefierd, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/443,477

(22) Filed: Apr. 10, 2012

(51) Int. Cl.
*B65H 39/10* (2006.01)

(52) U.S. Cl.
USPC ..... 271/301; 271/304; 271/186; 399/364

(58) Field of Classification Search
USPC ..... 271/225, 291, 301, 303, 304, 65, 271/184–186; 399/364
See application file for complete search history.

(56) References Cited

U.S. PATENT DOCUMENTS

| | | | |
|---|---|---|---|
| 5,265,864 | A | 11/1993 | Roux et al. |
| 5,409,201 | A | 4/1995 | Kramer |
| 5,409,202 | A | 4/1995 | Naramore et al. |
| 5,449,164 | A | 9/1995 | Quesnel et al. |
| 5,720,478 | A | 2/1998 | Carter et al. |
| 6,293,542 | B1 | 9/2001 | Bokelman |
| 6,311,972 | B1 | 11/2001 | Carter |
| 6,450,711 | B1 | 9/2002 | Conrow |
| 6,550,762 | B2 | 4/2003 | Stoll |
| 6,612,566 | B2 | 9/2003 | Stoll |
| 7,258,340 | B2 | 8/2007 | Clark et al. |
| 2010/0244354 | A1 | 9/2010 | Suh et al. |

*Primary Examiner* — Michael McCullough

(74) *Attorney, Agent, or Firm* — Maginot, Moore & Beck, LLP

(57) ABSTRACT

A dual path, single reversing roll inverter driven by a single actuator includes a single reversing roller with two, diametrically opposed idler rollers. The configuration of the reversing roller and idler rollers forms a first nip and a second nip that are alternately used to accept sequential sheets from a paper path. The first and second nips discharge the sheets into respective first and second inverting paths. A method for inverting sheets using the dual path, single reversing roll inverter includes rotating the roller in a first direction to direct a first sheet through the first nip. The roller is then rotated in a second direction opposite the first direction to direct the first sheet from the first nip and into the first inverting path and to simultaneously direct a second sheet into the second nip. A gate alternately directs the sequential sheets into the first and second nips.

18 Claims, 10 Drawing Sheets

DEVICE AND METHOD FOR HIGH-SPEED MEDIA INVERSION USING A DUAL PATH, SINGLE REVERSING ROLL INVERTER

TECHNICAL FIELD

This disclosure relates generally to media transport systems, and more particularly to devices for inverting media sheets in high-speed printers.

BACKGROUND

Imaging devices form images on image receiving surfaces that include paper and other print media. Different imaging or printing techniques, which include laser printing, inkjet printing, offset printing, dye-sublimation printing, thermal printing, and the like, may be used to produce printed documents. In particular, inkjet imaging devices eject liquid ink from printheads to form images on an image receiving surface. The image receiving surface may be a media substrate or an intermediate imaging member. The image on the intermediate imaging member is later transferred to media substrate. Once the ejected ink is on the image receiving surface, the ink droplets quickly solidify to form an image. A media transport system transports the media substrate along a media transport path from supply sources to the printheads or intermediate imaging member and then to subsequent stations for further processing, such as sheet output collation, finishing, and the like.

In many imaging devices, the media substrate is inverted and an image is formed on the reverse side of the substrate to generate a duplex or two-sided document. To perform such inversion, the media transport system includes an inverter for reversing the orientation of the media substrate and a duplex loop for returning the inverted media substrate to the printheads or the intermediate imaging member. An inverter typically includes an entrance path leading to a sheet driver, such as nip formed between a pair of rollers. The sheet driver draws the sheet from the entrance path into a reversing chute, reverses the direction of the sheet, and drives the sheet out of the reversing chute into the duplex loop for subsequent imaging of the non-imaged side.

As the process speeds of imaging devices generally become faster, duplex printing using these devices requires the sheets entering the inverter to be rapidly accelerated from the process speed to a much higher inverter speed. For example, in many high-speed imaging devices using a single inverter, the sheets are accelerated in a very short distance from a process to an inverter speed that is approximately twice the process speed for movement into the inverter. After the sheets enter the inverter, the sheets are rapidly decelerated from the higher inverter speed to a stop and then rapidly re-accelerated to the inverter speed for exiting from the inverter. The increased sheet velocities and accelerations required for inversion can damage the sheets and cause jams along the media transport path. Moreover, images produced using inkjet imaging devices are more sensitive to abuse than images produced using xerographic imaging devices, such as laser printers.

Some imaging devices implement a dual inverter system of two independent but cooperative sheet inverters to reduce the sheet velocities and accelerations needed to perform duplex printing at high process speeds. In these devices, the two inverters are sheet control gated to receive alternate sheets from the sheet path for inversion in the inverters. The dual inverters may operate at substantially the same sheet velocity as the sheet path instead of the much higher speed and acceleration/deceleration typical of conventional single inverter systems. However, adding multiple inverters along the media transport system increases the number of components needed to perform sheet inversion and the complexity of the system required to maintain proper sequencing of the inverted sheets. Accordingly, improvements to imaging devices that enable high-volume, high-speed sheet inversion with reduced inverter components and complexity would be beneficial.

SUMMARY

An inverter for inverting media sheets in a high-speed printer has been developed. The inverter includes separate inverting paths including at least a first inverting path and a second inverting path, a first idler roller, a second idler roller, a roller positioned between the first idler roller and the second idler roller to form a first nip between the roller and the first idler roller and to form a second nip between the roller and the second idler roller, a gate being configured to direct sequentially spaced apart printed sheets to the first and second nips in alternating sequence, and an actuator operatively connected to the roller, the actuator being configured to rotate the roller in a first direction to direct a first sheet of the sequentially spaced apart printed sheets received from the gate into the first nip, and rotate the roller in a second direction opposite the first direction to direct the first sheet from the first nip and into a first inverting path and to simultaneously direct a second sheet of the sequentially spaced apart printed sheets received from the gate into the second nip.

A method of inverting media sheets in a high-speed printer has been developed. The method includes moving sequentially spaced apart printed sheets along an output path, selectably directing selected sheets of the sequentially spaced apart printed sheets from the output path into one of a first inverting path and a second inverting path, operating an actuator to rotate a roller that is in circumferential contact with two opposed idler rollers, the roller and one of the idler rollers forming a first nip in the first inverting path and the roller and the other idler roller forming a second nip in the second inverting path, rotating the roller in a first direction to direct a first sheet of the sequentially spaced apart sheets through the first nip, and rotating the roller in a second direction opposite the first direction to direct the first sheet from the first nip and into the first inverting path and to simultaneously direct a second sheet of the sequentially spaced apart printed sheets into the second nip.

To implement the method of inverting media sheets in a high-speed printer, a printer has been developed. The printer includes a first idler roller, a second idler roller, a roller positioned between the first idler roller and the second idler roller to form a first nip between the roller and the first idler roller and to form a second nip between the roller and the second idler roller, a gate being configured to direct sequentially spaced apart printed sheets to the first and second nips in alternating sequence, an actuator operatively connected to the roller, the actuator being configured to rotate the roller to direct the sequentially spaced apart printed sheets into and out of, respectively, each of the first and second nips, and a controller operatively connected to the actuator, the controller being configured to operate the actuator to rotate the roller in a first direction to direct a first sheet of the sequentially spaced apart sheets into the first nip, and operate the actuator to rotate the roller in a second direction opposite the first direction to direct the first sheet out of the first nip and into a first inverting path and to simultaneously direct a second sheet of the sequentially spaced apart printed sheets into the second nip.

BRIEF DESCRIPTION OF THE DRAWINGS

The foregoing aspects and other features of the dual path, single reversing roll inverter and associated method for inverting sheets using the same are explained in the following description, taken in connection with the accompanying drawings.

DETAILED DESCRIPTION

Figure 7:
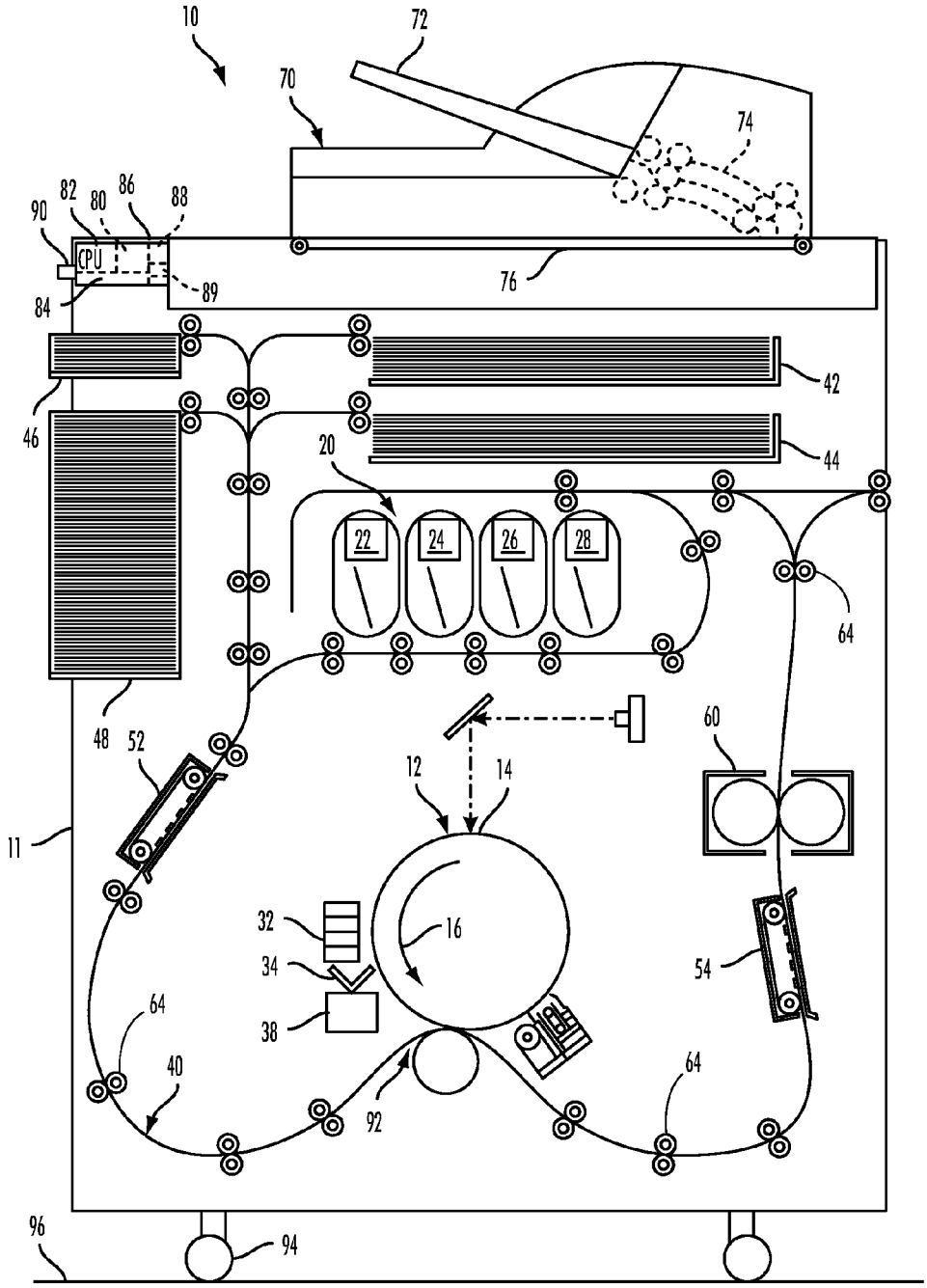
FIG. 7 (PRIOR ART)
FIG. 7 is a block diagram of a prior art phase change ink printer with duplex printing capability.

For a general understanding of the environment for the dual path, single reversing roll inverter disclosed herein as well as the details for the system and method for using the inverter, the drawings are referenced throughout this document. In the drawings, like reference numerals designate like elements. Referring now to FIG. 7, a phase change ink printer 10 is depicted. As illustrated, the printer 10 includes a frame 11 to which are mounted directly or indirectly all operating subsystems and components of the printer 10. The printer 10 further includes an imaging member 12 that is shown in the form of a drum, but can equally be in the form of a supported endless belt. The imaging member 12 has an imaging surface 14 that is movable in the direction 16, and on which phase change ink images are formed.

The printer 10 further includes a phase change ink system 20 that has at least one source 22 of one color phase change ink in solid form. As illustrated, the printer 10 is a multicolor image producing machine, and the ink system 20 includes, e.g., four (4) sources 22, 24, 26, 28, representing four (4) different colors of phase change inks, e.g., CYMK (cyan, yellow, magenta, black). The phase change ink system 20 also includes a phase change ink melting and control assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. As is generally known, phase change inks are typically heated to a melting temperature of approximately 70° C. to 140° C. to melt the solid ink for delivery to the printhead(s).

After the solid ink is melted, the phase change ink melting and control assembly controls and supplies the molten liquid form of the ink towards a printhead system including at least one printhead or printhead assembly 32. Suitably, for a four (4) color multicolor printer, the printhead assembly includes four (4) separate printheads, i.e., one printhead for each color, as shown in the figure. In other embodiments, each printhead can be implemented with a staggered array of printheads as is known in the art. In these embodiments, two arrays are configured to print at a first resolution and the other two arrays are configured to print at the same resolution. The latter two arrays, however, are offset from the other two arrays by one-half of the distance between adjacent nozzles to double the resolution of the printing performed by the four arrays of the assembly. The printheads in all of the arrays of an assembly can be configured to eject the same color of ink. Thus, four assemblies, each having four arrays, can be configured to print four colors of ink. However, for simplicity only one printhead assembly 32 is shown. Optionally, any suitable number of printheads or printhead assemblies can be employed.

Referring still to FIG. 7, the printer 10 further includes a substrate supply and handling system 40. The substrate supply and handling system 40 includes substrate supply sources 42, 44, 46, 48, of which supply source 48, for example, is a high capacity paper supply or feeder configured to store and supply image receiving substrates in the form of cut sheets. The substrate supply and handling system 40 further includes a substrate handling and treatment system that has a substrate pre-heater 52, a substrate and image heater 54, and a fusing device 60. The printer 10 as shown can also include an original document feeder 70 that has a document holding tray 72, document sheet feeding and retrieval devices 74, and a document exposure and scanning system 76. In the embodiment shown, the substrate supply and handling system 40 also includes a single path inverter 61 and a duplex loop 62 exiting from the inverter 61, both of which are shown in FIG. 8 and discussed in more detail immediately below.

Figure 8:
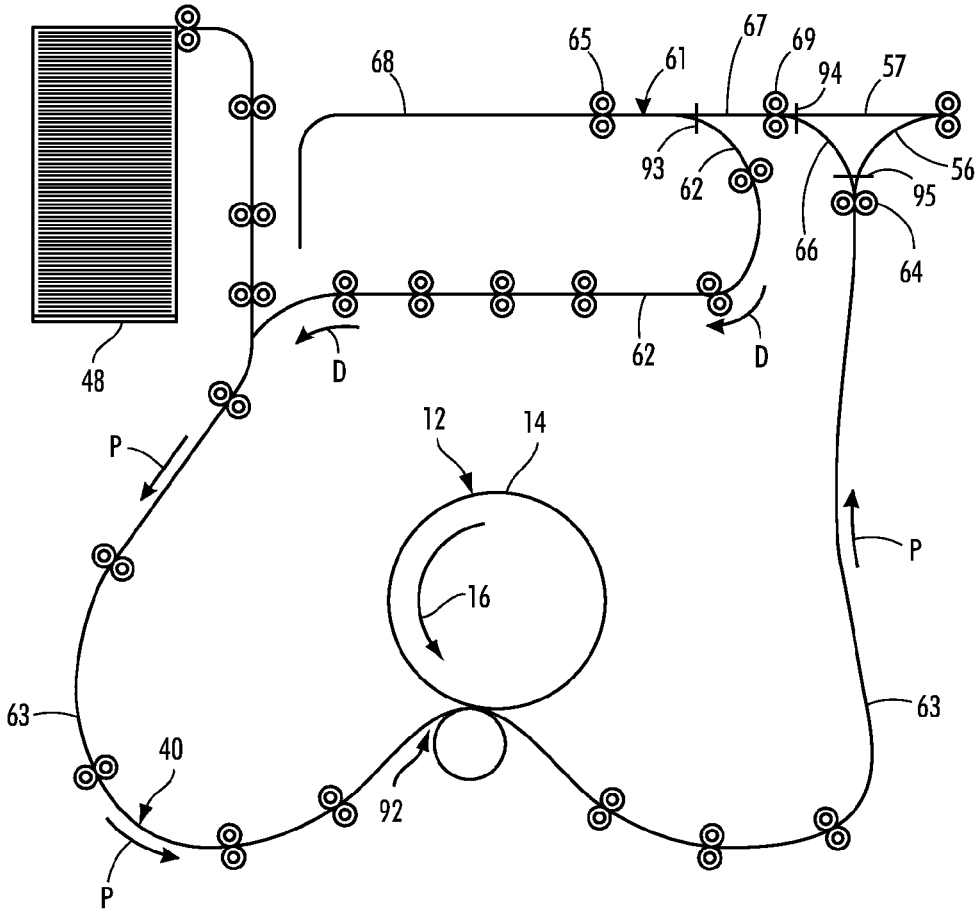
FIG. 8 (PRIOR ART)
FIG. 8 is schematic representation of a prior art substrate supply and handling system associated with the printer of FIG. 7.

Referring now to FIG. 8, a simplified elevation view of the substrate supply and handling system 40 of FIG. 7, which includes both the inverter 61 and the duplex loop 62, is shown. Sheets (substrates) comprising any medium on which images are to be printed, such as paper, transparencies, boards, labels, and the like are drawn from the substrate supply source 48 by a feed mechanism (not shown). The sheets are moved along a primary loop 63 in a process direction as indicated by arrows (P) by sheet feed mechanisms 64 toward what can be generally called a "marking station." The sheet feed mechanisms 64 can comprise any form of device that is adapted to move a sheet or substrate. For example, the sheet feed mechanisms 64 can include nip rollers or a belt adapted to frictionally move the sheet and can include air pressure or suction devices to produce sheet movement. The sheet feed mechanisms 64 can further include pairs of opposing wheels (one or both of which can be powered) that pinch the sheets.

In the illustrated embodiment, the marking station is the imaging surface 14 of the imaging member 12. In alternative embodiments, however, the marking station can be a xerographic photoreceptor or an inkjet printhead. One or more controllers (not shown) can control the sheet feed mechanisms 64 and the marking station as discussed in more detail below. In operation, the marking station 14 places a predetermined image on an upward-facing side of a sheet passing the station 14.

When duplex printing is desired, the sheet is inverted and re-fed to the marking station 14 so that the marking station 14 can place a predetermined image on the upward-facing, previously downward facing, side of the sheet passing the station 14. To perform such inverting and re-feeding, the inverter 61 and the duplex loop 62 are used. After passing through the marking station 14, a sheet requiring duplex printing is directed from the primary loop 63 to an intermediate inverting path 66 and then to an inverting path 67. The inverting path 67 leads to the inverter 61, which is shown in more detail in FIG. 9. The inverter 61 includes a reversing feed mechanism, such as duplex reversing rollers 65, into which the sheet enters, and then exits in a reverse direction of motion towards the duplex loop 62.

The duplex loop 62 conveys the sheet back to the marking station 14 in a direction as indicated by arrows (D). The action of the inverter 61 and the duplex loop 62 effectively turn the sheet over, and the side of the sheet that had not received the initial image is placed face-up to receive the second-side image at the marking station 14. After duplex printing, the sheet is directed either to a first discharge path 56 leading directly to a discharge area (not shown) or again to the inverter 61 for subsequent inversion before being conveyed to a second discharge path 57 similarly leading to the discharge area. In the case of printing a "simplex" sheet, meaning a sheet having an image on only one side, the sheet can be directed from the primary loop 63 to the discharge area (which may be directed to, for instance, a catch tray or other finishing device, such as a stapler) without passing through the duplex loop 62. The simplex sheet can similarly be directed from the primary loop 63 to the inverter 61 for subsequent inversion, but without passing through the duplex loop 62, before being conveyed to the discharge area.

Referring again to FIG. 7, operation and control of the various subsystems, components, and functions of the printer 10 are performed with the aid of a controller 80. The controller 80, for example, is a self-contained, dedicated mini-computer having a central processor unit (CPU) 82 with electronic storage 84, and a display or user interface (UI) 86. The controller 80 includes a sensor input and control circuit 88 as well as a pixel placement and control circuit 89. In addition, the CPU 82 reads, captures, prepares, and manages the image data flow between image input sources, such as the scanning system 76 or an online or a work station connection 90, and the printhead assembly 32. As such, the controller 80 is the main multi-tasking processor for operating and controlling all of the other printer subsystems and functions.

The controller 80 further includes memory storage for data and programmed instructions. The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the functions of the printer 10. These components can be provided on a printed circuit card or provided as a circuit in an application specific integrated circuit (ASIC). Each of the circuits can be implemented with a separate processor or multiple circuits may be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced is sent to the controller 80 from either the scanning system 76 or via the online or work station connection 90 for processing and output to the printhead assembly 32. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assembly 32. Pixel placement control is exercised relative to the imaging surface 14 to form desired images per such image data, and image receiving substrates are supplied by any one of the sources 42, 44, 46, 48 and handled by the substrate handling and treatment system 50 in timed registration with image formation on the surface 14. Finally, the image is transferred from the surface 14 onto the receiving substrate within the transfer nip 92 and delivered to the fusing device 60 for subsequent fusing of the image to the substrate.

Figure 9:
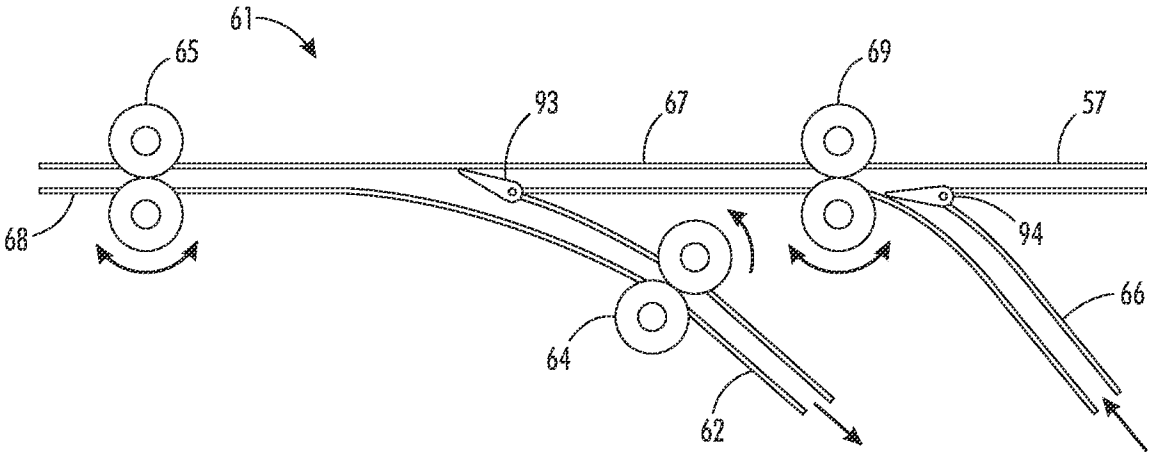
FIG. 9 PRIOR ART
FIG. 9 is schematic frontal view of one embodiment of a prior art inverter associated with the substrate and handling system of FIG. 8.

Referring now to FIG. 9, the inverter 61 of FIG. 8 is shown. The inverter 61 depicted in FIG. 9 is an embodiment of a simple inverter capable of reversing the direction of a sheet and delivering that sheet to the duplex loop 62 for subsequent duplex printing. The inverter 61 includes an inverting path 67 configured to direct sheets to the duplex reversing rollers 65. While the inverting path 67 as shown is a straight path, the shape of the inverting path 67 can be any suitably geometry that directs sheets to the duplex reversing rollers 65, such as a curved path. The sheet feed mechanisms 64 propel the sheets along the inverting path 67 towards the duplex reversing rollers 65.

The duplex reversing rollers 65 are positioned to receive the sheets along the inverting path 67 and configured to draw in the sheets and reverse the direction of travel of the sheets. In the embodiment shown, the duplex reversing rollers 65 draw the sheets into a reversing chute 68 that is coterminous with the inverting path 67. In an alternative embodiment, the duplex reversing rollers 65 can draw the sheets into an open area opposite the inverting path 67 as long as the duplex reversing rollers 65 remain in contact with at least a portion of each sheet. The drawing, stopping, and reversing of the sheets entering the inverter 61 are performed using the duplex reversing rollers 65, which can be two nip rollers (or similar mechanisms) that are configured to frictionally move the sheets therein.

The inverter 61 can include a first gate 93 that directs sheets exiting the duplex reversing rollers 65 towards the duplex loop 62 or optionally towards the inverting path 67 from which the sheets were originally delivered. If the inverter 61 is configured to direct sheets only towards the duplex loop 62, then the at least one duplex gate 93 can be a passive, one-way gate. The one-way gate can be a non-actuated gate, such as a conductive light spring steel or plastic material, which allows paper to pass through the gate and then spring back to its normal form. If the inverter 61 is configured to direct sheets towards the duplex loop 62 and towards the inverting path 67, then the first gate 93 can be operated as a decision gate. When activated, the decision gate extends into one of the inverting path 67 and the duplex loop 62 to engage the leading edge of a selected sheet and deflect that sheet into the duplex loop 62 or inverting path 67, respectively. The controller 80 in the associated printer 10 of FIG. 7 operates an actuator operatively connected to the controller to manipulate the first gate 93 if the gate is operated as a decision gate.

The sheets directed towards the duplex loop 62 are moved along the duplex loop 62 by the sheet feed mechanisms 64 until the sheets re-converge with the primary loop 63. In the embodiment shown, the sheets re-directed towards the inverting path 67 are moved by a bi-directional sheet feed mechanism 69 along the second discharge path 57 to the discharge area. The bi-directional sheet feed mechanism 69 is configured to direct selected sheets to the duplex reversing rollers 65 for inversion and to receive selected sheets from the duplex reversing rollers 65 for discharge from the printer 10. In one embodiment, the bi-directional sheet feed mechanism 69 can optionally be used to invert previously simplex or duplex printed sheets before being conveyed to the discharge area.

Referring now to FIGS. 8 and 9, a second gate, shown as passive, one-way gate 94, ensures that the sheets do not re-enter the intermediate inverting path 66 once the sheets are conveyed to the inverting path 67. A third gate, operated in the figure as a decision gate 95, directs sheets from the primary loop 63 to one of the intermediate inverting path 66 or the first discharge path 56 depending on the printing or orientation requirements of the sheets approaching the gate.

Figure 10:
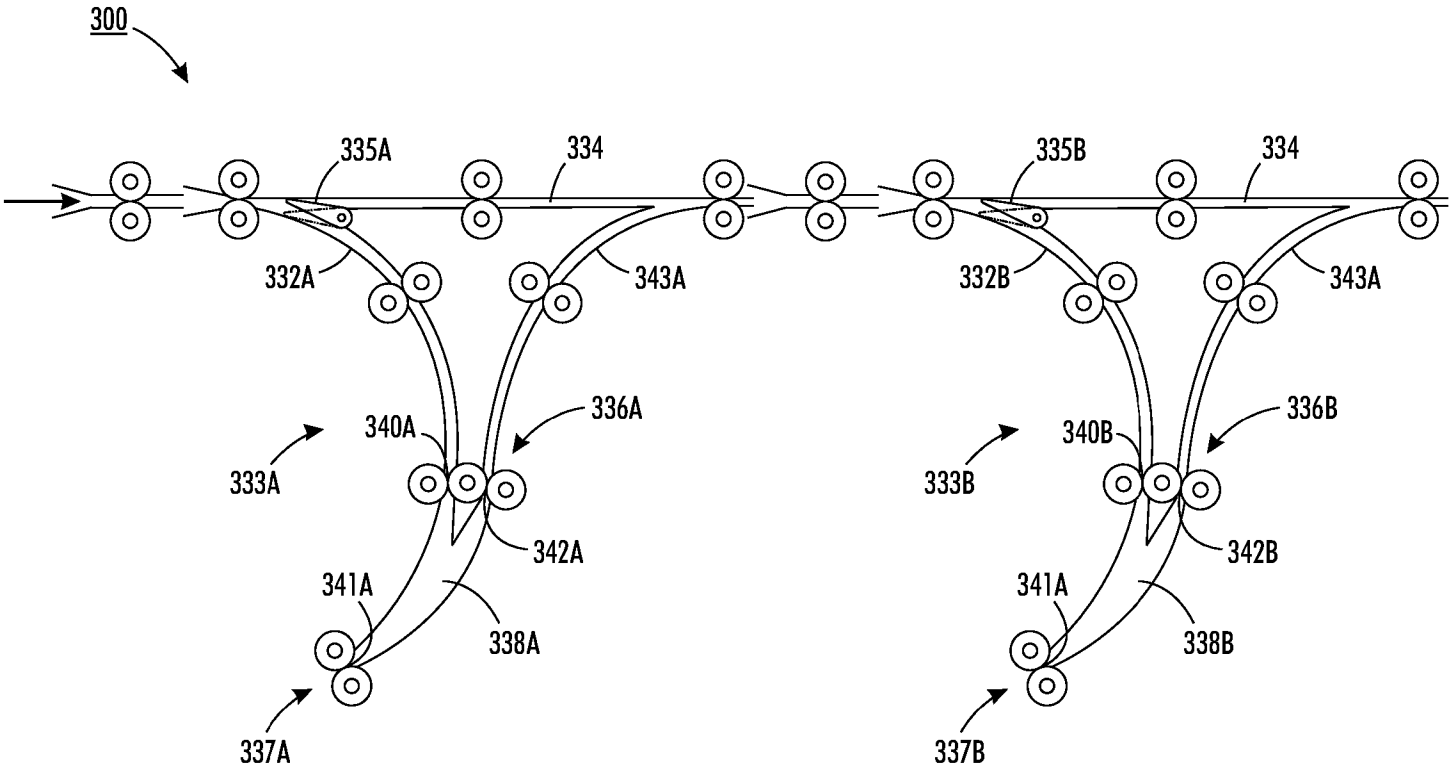
FIG. 10 (PRIOR ART)
FIG. 10 is a schematic frontal view of a prior art dual inverter system in a cooperative series configuration along a paper path.

Referring now to FIG. 10, a prior art dual inverter system 300 consisting of two adjacent inverters 333A and 333B in parallel is shown. The inverters 333A, 333B depicted are a conventional type of "three roll" or "tri roll" inverter that can be used in high-speed duplex printers, such as the printer 10 of FIG. 7. Both of these inverters 333A, 333B have entrance paths 332A, 332B connecting to a common paper path 334, such as primary loop 63 of the printer 10 of FIG. 7, at adjacent but spaced apart positions. Respective gates 335A, 335B operate as decision gates to control the connection between the paper path 334 and the inverters 333A, 333B. When activated, these gates 335A, 335B extend into the paper path 334 to engage the leading edge of a selected sheet in the paper path 334 and deflect that sheet into the respective inverter entrance paths 332A, 332B of the inverters 333A, 333B. The operation of the actuators that move the decision gates 335A, 335B, and other operations, can be performed by a conventional controller 80 configured with appropriate instructions stored in a memory operatively connect to the controller, such as the controller 80 in the printer 10 of FIG. 7. Alternatively, the gates 335A, 335, and other operations, can be controlled by a separate modular controller of the dual inverter system 300, which may be a modular unit for the printer, and/or part of a finisher module.

When a print job requires sheet inversion, the controller 80 can alternatingly actuate the decision gates 335A, 335B between each sequential sheet in the sheet path 334 to direct alternate sequential sheets that are moving in the paper path 334 into alternate inverters 333A, 333B. The construction and operation of each of the tri roll inverters 333A, 333B can be both identical and conventional. In particular, each of the inverters 333A, 333B has respective conventional tri-rolls 336A, 336B and inverter chute reversing rolls 337A, 337B in their respective curved inverting chutes 338A, 338B. Both inverters 333A, 333B are preferably positioned on the same side of the paper path 334 for vertical operating space reasons.

To better understand the operation of the dual inverter system 300, the sequential operation of a single tri roll inverter, such as inverter 333A, is now described. A first sheet is directed into the inverter entrance path 332A towards an entrance nip 340A of the tri roll 336A. As the trail end of the first sheet exits the entrance nip 340A, the reversing nip 341A formed by the inverter chute reversing rolls 337A slows the sheet to a stop, reverses the direction of the sheet, and accelerates the sheet back to the tri roll velocity. The reversing nip 341A delivers the sheet to an exit nip 342A of the tri roll 336A towards an inverter output path 343A. Once the trail end of the first sheet exits the reversing nip 341A, the reversing rolls 337A decelerate to a stop, reverse direction, and then accelerate back to the tri roll velocity to accept a second sheet. For a printer to achieve an inversion rate of 250 pages per minute (ppm), the inversion cycle time is only 240 msec. Since each of these inverter operations occur serially, the sheet velocities and accelerations required to use a single inverter of this type for duplex printing are very high and cause concern for sheet damage and jams.

The sequential operation of the dual inverter system 300 for two sequential sheets is now described. As the two sequential sheets move along the paper path 334 towards the inverters 333A, 333B, a first sheet is gated into the first inverter 333A whereas a second sheet is directed past the first inverter 333A. While the second sheet is still moving past the first inverter 333A, the first sheet is drawn through the entrance nip 340A of the tri-roll 336A into the inverting chute 338A. Once in the inverting chute 338A, the inverter chute reversing roll 337A quickly decelerates the first sheet to a stop and then reverses the direction of the sheet towards the exit nip 342A of the tri-roll 336A. Then, as the first sheet is being drawn through the exit nip 342A of the tri-roll 336A towards the paper path 334, the second sheet is gated into the second inverter 333B. As the second sheet enters the second inverter 333B, the first sheet re-converges with the paper path 334 and is moved along the paper path 334 towards the second inverter 333B. Close in time with the first sheet passing the second inverter 333B, the second sheet is inverted in the second inverter 333B and is moved towards the paper path 334. Every two sequential sheet combinations can follow this same sequence and, thus, the final sheet order and inter-sheet gap can be the same as the initial inter-sheet gap and sheet order in the paper path.

Figure 1:
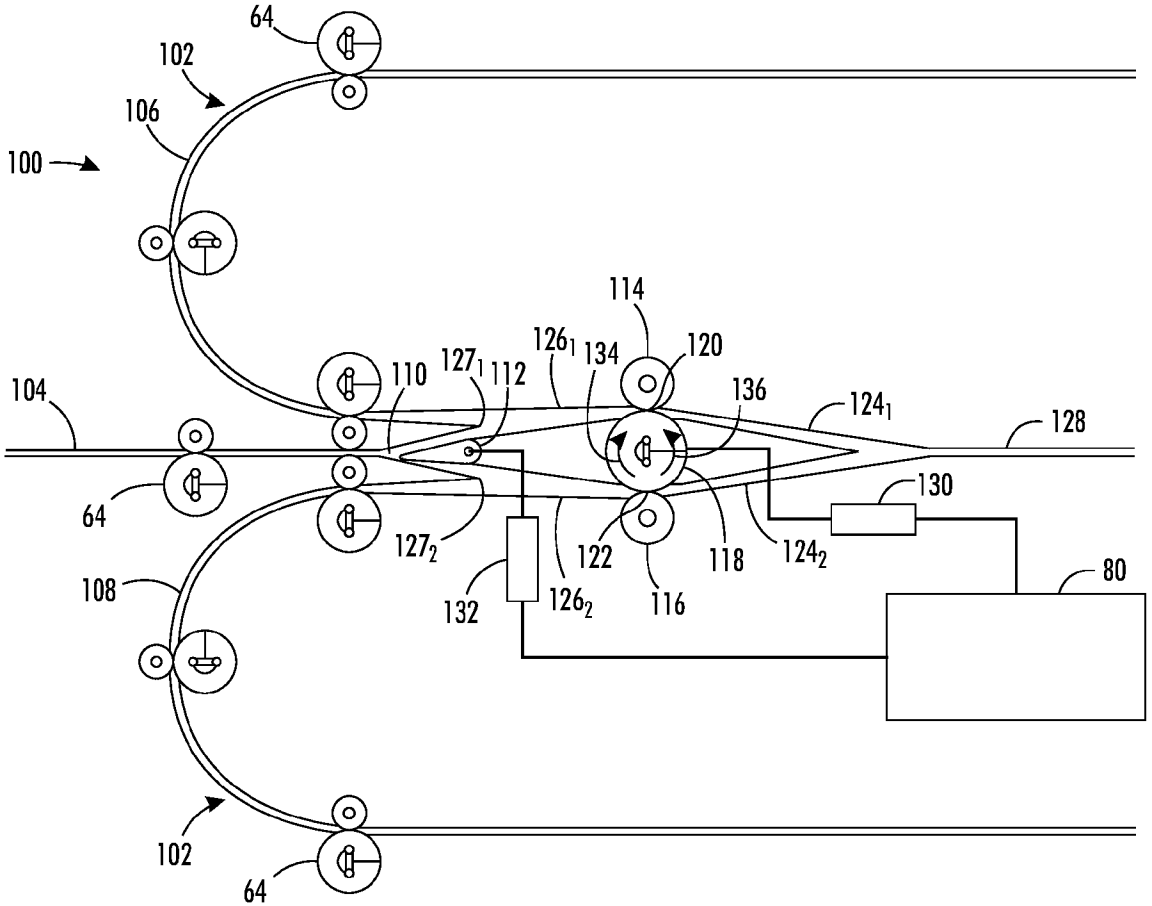
FIG. 1 is schematic representation of one embodiment of the dual path, single reversing roll inverter disclosed herein.

Referring now to FIG. 1, an embodiment of the dual path, single reversing roll inverter disclosed herein is shown. This embodiment as well as other embodiments of the dual path, single reversing roll inverter 100 can be integrated with high-speed duplexing printers, such as the printer 10 of FIG. 7. The single reversing roll inverter 100 disclosed herein is capable of high-speed inversion at an inversion rate of approximately 250 ppm while operating with paper transport speeds of 1060 mm/sec and accelerations of less than 2.16 G. These transport speeds and accelerations are significantly less than the paper transport speeds and accelerations of similar single reversing roll inverters inverting sheets at 250 ppm. For example, the reversing roll of a single tri roll inverter having a tri roll velocity equal to 1060 mm/sec (a typical transfix roll velocity of high-speed printers) must accelerate and decelerate sheets at a rate of 5.96 G to maintain a 250 ppm rate. If the tri roll velocity of this inverter is increased, the inter document gap between the sequentially spaced apart sheets is similar increased and, hence, more time is available to accelerate and decelerate the sheets. However, diminishing returns exist as the tri roll velocity is increased. For example, calculations show that tri roll velocities of 1600 mm/sec or more do not reduce accelerations below approximately 3.1 G.

The dual path, single reversing roll inverter 100 includes separate inverting paths 102 configured to receive sequentially spaced apart printed sheets from an output path 104, such as the primary loop 63 of the printer 10 (FIG. 7). In the embodiment shown in FIG. 1, these separate inverting paths 102 include at least a first inverting path 106 and a second inverting path 108 that form a duplex loop. The first and second inverting paths 106, 108 preferably converge to a single path before returning to the primary loop and passing the printheads. In an alternative embodiment, the first and second inverting paths 106, 108 can form discrete duplex loops that join with the primary loop 63.

The sheet feed mechanisms 64 move the sequentially spaced apart printed sheets along the output path 104 and through the inverter 100. The sheet feed mechanisms 64 can comprise any form of device that is adapted to move a sheet or substrate. For example, the sheet feed mechanisms 64 can include nip rollers or a belt adapted to frictionally move the sheet and can include air pressure or suction devices to produce sheet movement. The sheet feed mechanisms 64 can further include pairs of opposing wheels (one or both of which can be powered) that pinch the sheets.

The dual path, single reversing roll inverter 100 further includes an inverter entrance 110 into which the sequentially spaced apart printed sheets are received from the output path 104. The inverter entrance 110 leads to both the first and second inverting paths 106, 108. A gate 112 is located near the inverter entrance 100 and is configured to selectively direct the sequentially spaced apart printed sheets towards the first and second inverting paths 106, 108. The gate 112 is discussed in more detail below.

The inverter 100 further includes a first idler roller 114, a second idler roller 116, and a roller 118 positioned between the first and second idler rollers 114, 116. The roller 118 is in circumferential contact with the first and second idler rollers 114, 116. This configuration forms a first nip 120 between the roller 118 and the first idler roller 114 and a second nip 122 between the roller 118 and the second idler roller 116. The first and second idler rollers 114, 116 are preferably positioned about the roller 118 in diametric opposition, aligning the first and second nips 120, 122 with the first and second inverting paths, respectively.

The first and second inverting paths 106, 108 each include a reversing portion $\mathbf{124}_x$ and a discharge portion $\mathbf{126}_x$. The reversing portion 124, is an area behind the respective first and second nips 120, 122 into which the sequential sheets are drawn before the direction of the sheets is reversed. The discharge portion $\mathbf{126}_x$ is an area in front of the respective first and second nips 120, 122 into which the sequential sheets are discharged after the direction of the sheets is reversed. The discharge portion 126*x* is proximate to and cooperative with both the inverter entrance 110 and the first and second inverting paths 106, 108.

A bypass path 128 is disposed proximate to and cooperative with the reversing portion 124, of each of the first and second inverting paths 106, 108. The bypass path 128 enables the sequentially spaced apart printed sheets to bypass the first and second inverting paths 106, 108 when simplex printing is desired or when the sequential sheets have already been duplex printed.

The inverter entrance 110 is configured such that as the sequential sheets enter the inverter 100, the sheets are biased towards the respective first and second inverting paths 106, 108 after the sheets pass a biasing feature, such as biasing feature $\mathbf{127}_g$. The biasing feature 127, of each of the first and second inverting paths 106, 108 ensures that the sheets reversed by the roller 118 are properly discharged into the first and second inverting paths 106, 108 and are not discharged back into the inverter entrance 110.

The inverter 100 further includes an actuator 130 operatively coupled to the roller 118. The actuator 130 is configured to rotate the roller 118 to direct the sequentially spaced apart printed sheets into and out of, respectively, each of the first and second nips 120, 122. A controller, such as the controller 80 of the printer 10, is operatively connected to the actuator 130 and configured to operate the actuator 130 to rotate the roller 118 in a first direction (as indicated by arrow 134) and a second direction (as indicated by arrow 136) opposite the first direction 134.

The inverter 100 optionally includes a gate actuator 132 operatively coupled to the gate 112. The controller 80 is operatively connected to the gate actuator 132 if so equipped. In one embodiment, the controller 80 is configured to operate the gate actuator 132 to move the gate 112 between a first position and a second position to selectably direct selected sheets of the sequentially spaced apart printed sheets from the output path 104 into one of the first and second nips 120, 122. In an alternate embodiment, the controller 80 is configured to move the gate 112 and maintain the position of the gate 112 at one of the first and second positions. This embodiment enables sequential sheets to be guided to only one of the first and second nips 120, 122 for inversion along the first and second inverting paths, respectively, if the other one of the first and second nips 120, 122 and/or associated first and second inverting paths 106, 108 are not functioning properly. In yet another embodiment, the controller 80 is similarly configured to move the gate 112 and maintain the position of the gate 112 at one of the first and second positions. However, this embodiment enables sequential sheets to be guided through only one of the first and second nips 120, 122 and into the bypass path if sheet inversion is not desired.

Figure 2:
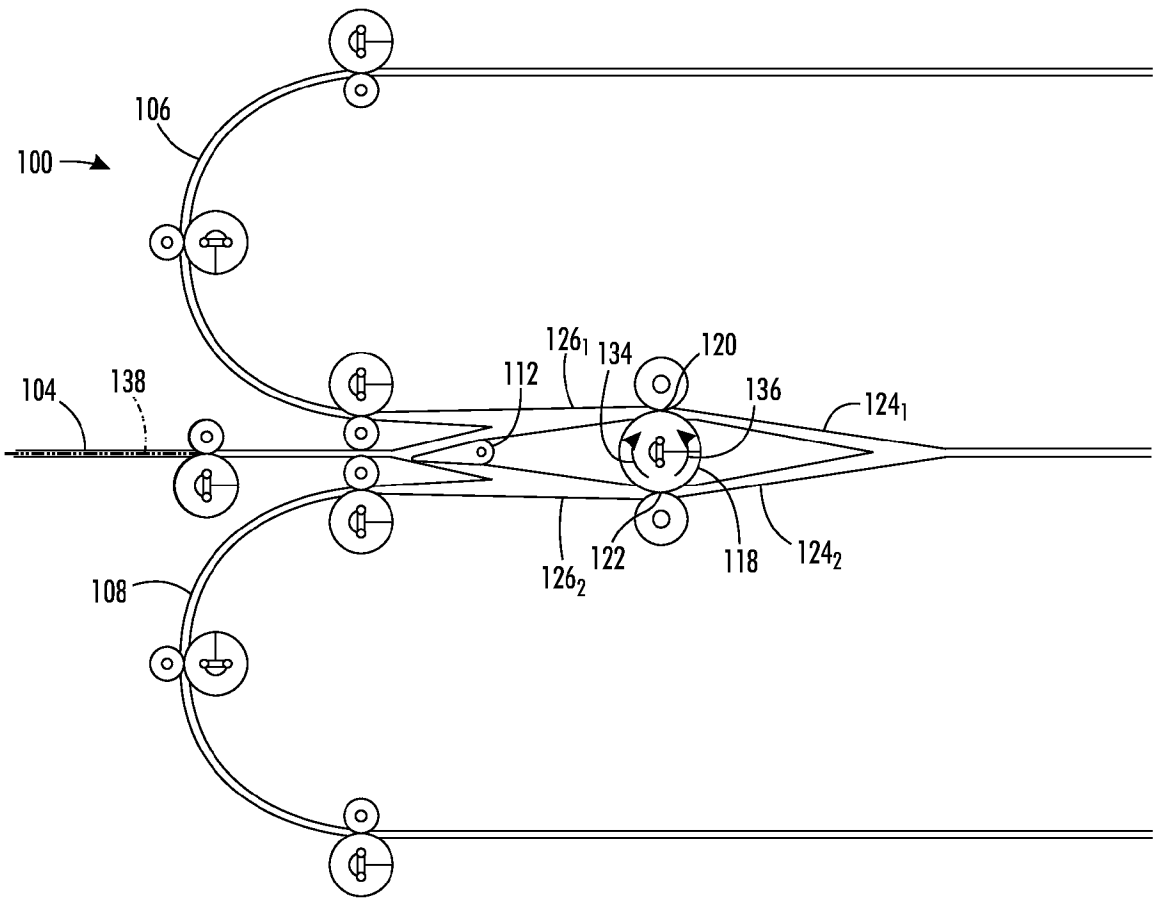
FIGS. 2, 3, 4, and 5 show the dual path, single reversing roll inverter of FIG. 1 in four sequential operating positions for the inversion of three sequential sheets in a paper path.
Figure 3:
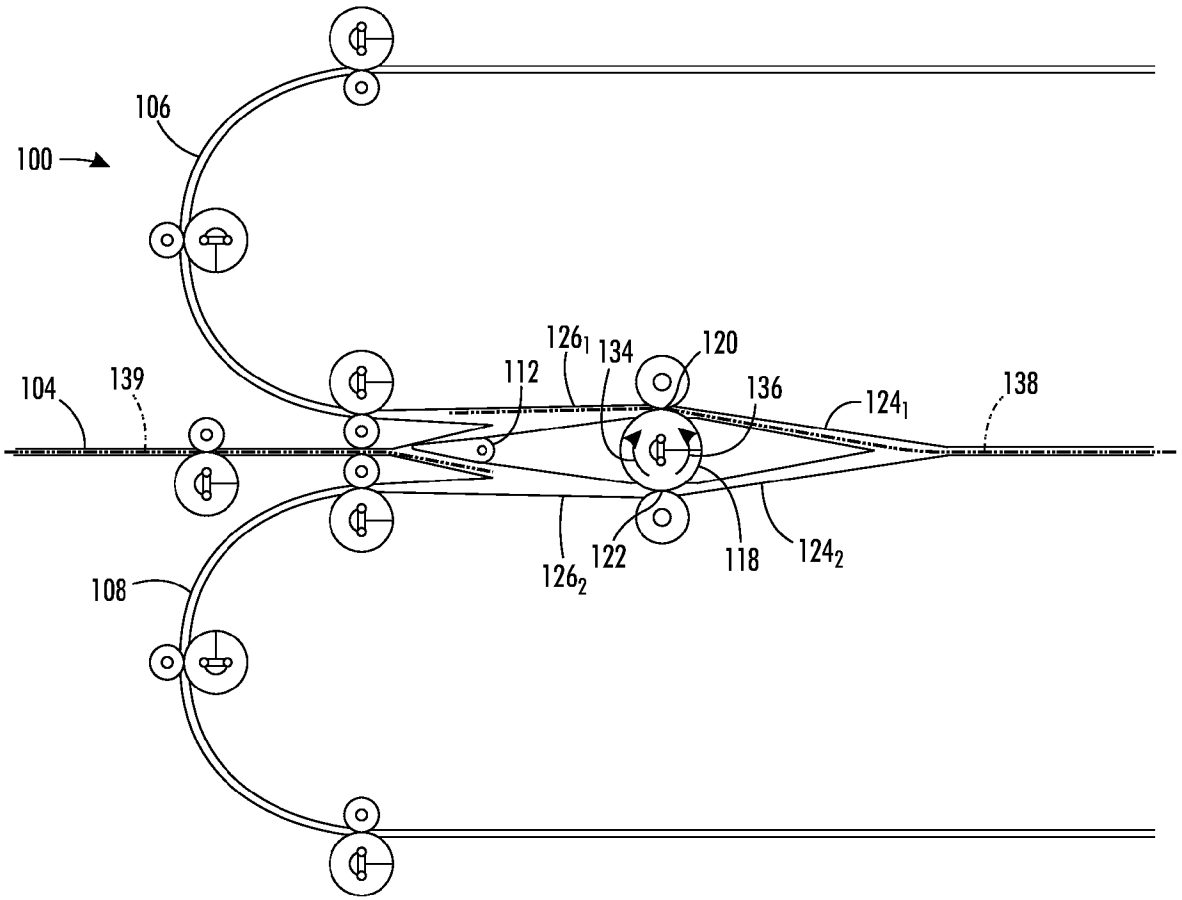

FIGS. 2-5 show the dual path, single reversing roll inverter 100 of FIG. 1 in four sequential operating positions for the inversion of three sequential sheets delivered to the inverter 100. In the embodiment depicted in FIGS. 2-5, the dimensions of the sequential sheets are 8.5×.11 inches. Also in this embodiment, the sheets are traveling at a high process speed, such as 1060 mm/sec, with an inter sheet gap of 38.4 mm between the sequential sheets. Referring now to FIGS. 2 and 3, the sequential sheets are moved toward the inverter 100 along the output path 104. The gate 112 is moved within the inter sheet gap to deliver a first sheet 138 to the first nip 120 of the first inverting path 106 and a second sheet 139 to the second nip 122 of the second inverting path 108.

Figure 4:
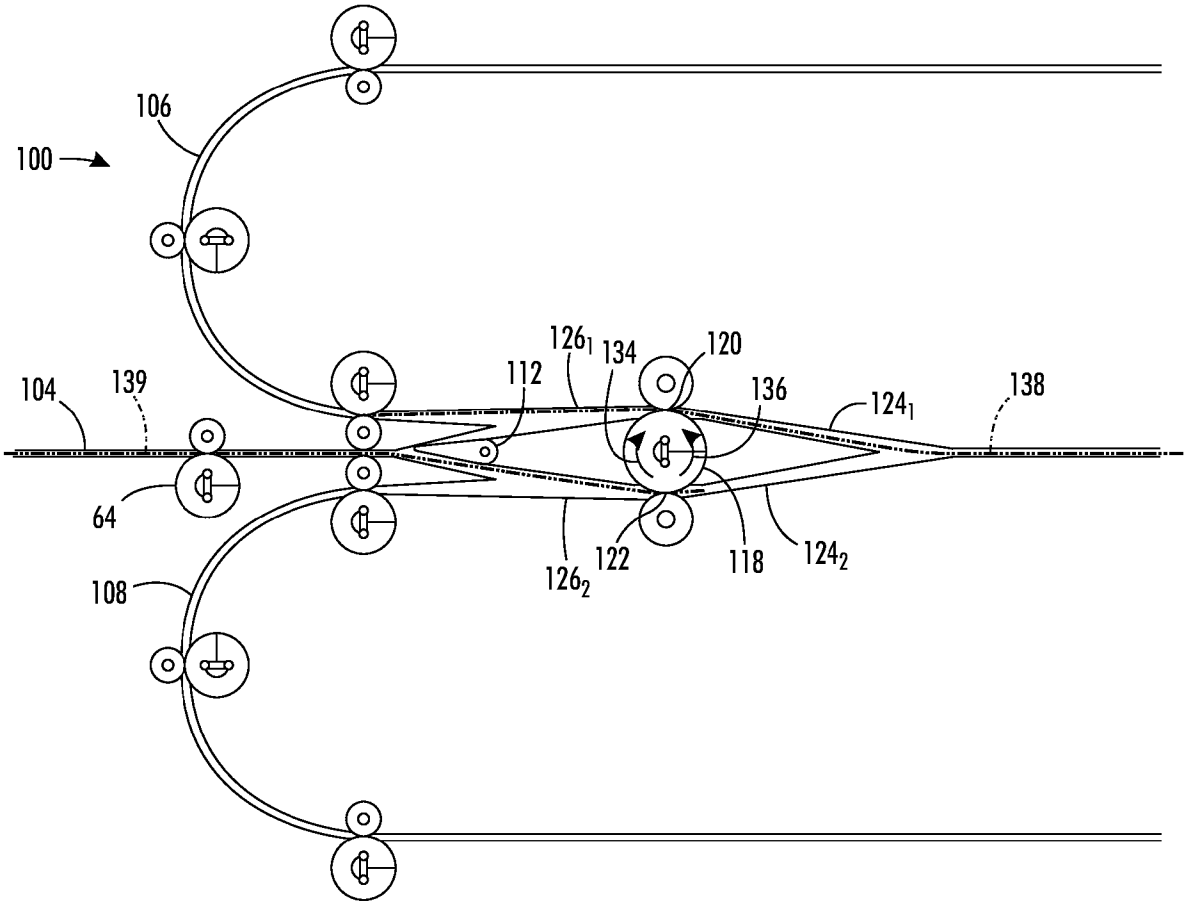

Referring now to FIG. 3, once the first sheet 138 is drawn into the reversing portion $\mathbf{124}_1$ of the first inverting path 106, the roller 118 is slowed down, stopped, and the direction of the roller 118 is reversed from direction 134 to direction 136. Reversing the direction of the roller 118 from direction 134 to direction 136 enables the roller 118 to rotate in the proper direction for the second nip 122 to receive the second sheet 139 from the output path 104. Referring now to FIG. 4, the second sheet 139 is drawn into the reversing portion $\mathbf{124}_2$ of the second inverting path 108 while the first sheet 138 is being driven out into the discharge portion $\mathbf{126}_1$ of the first inverting path 106. Before the second sheet 139 arrives at the roller 118 for sheet inversion, the roller 118 accelerates to the process speed because the sequential sheets are entering the inverter 100 at the process speed.

Figure 5:
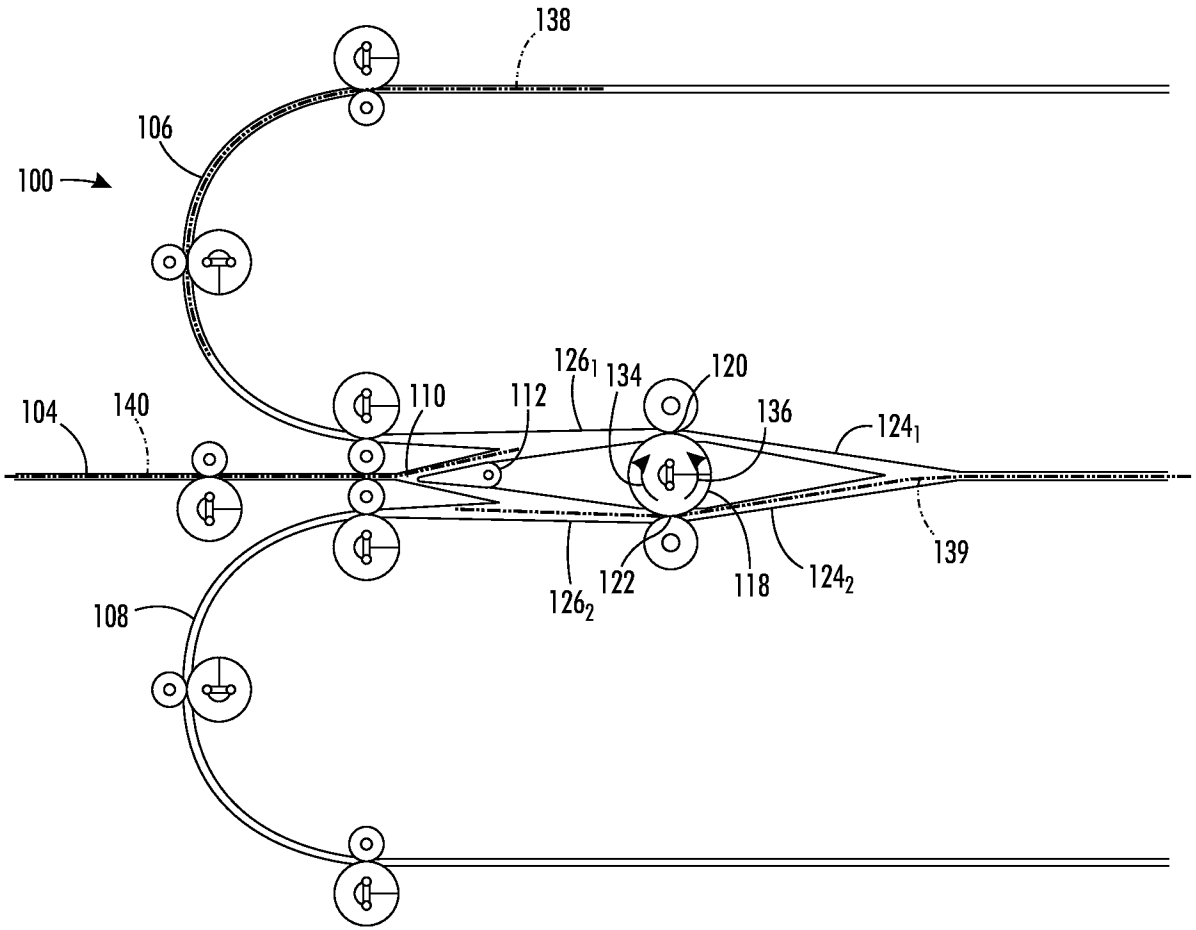

Referring now to FIG. 5, once the first sheet 138 exits the first nip 120 into the first inverting path 106 and the second sheet 139 is drawn into the reversing portion $\mathbf{124}_2$ of the second inverting path 108, the roller 118 is slowed down, stopped, and the direction of the roller 118 is reversed from direction 136 to direction 134. Reversing the direction of the roller 118 from direction 136 to direction 134 enables the roller 118 to rotate in the proper direction for the first nip 120 to receive a third sheet 140 from the output path 104. The third sheet 140 is drawn into the reversing portion $\mathbf{124}_1$ of the first inverting path 106 while the second sheet 139 is being driven out into the discharge portion $\mathbf{126}_2$ of the second inverting path 108. Before the third sheet 140 arrives at the roller 118 for sheet inversion, the roller 118 accelerates to the process speed because the sequential sheets are entering the inverter 100 at the process speed. The inversion sequence alternates and repeats every 240 msec to maintain 250 ppm.

Figure 6:
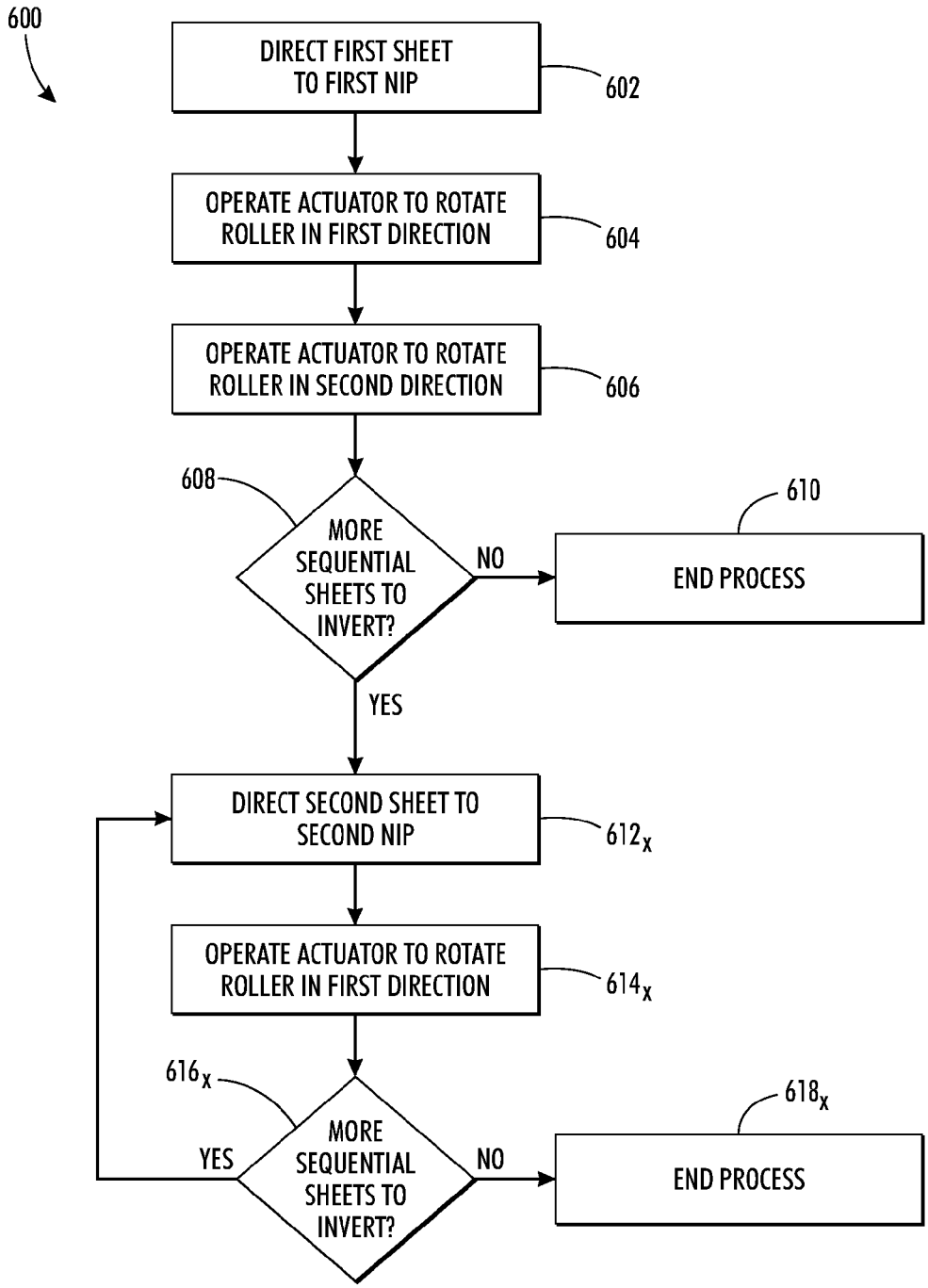
FIG. 6 is a flow diagram of a process for inverting sequentially spaced apart printed sheets in a printer using the dual path, single reversing roll inverter.

A flow diagram of a process 600 that uses the dual path, single reversing roll inverter to invert sequentially spaced apart printed sheets in a printer is shown in FIG. 6. The controller configured to execute the programmed instructions to implement the process 600 selectably directs a first sheet of the sequentially spaced apart printed sheets from an output path toward a first inverting path (block 602). In one embodiment, the controller can operate a gate actuator to move a gate within the inter sheet gap of the sequentially spaced apart sheets between a first position and a second position. Positioning the gate at the first and second positions directs the sequential sheets from the output path toward one of the first inverting path and a second inverting path, respectively. In this embodiment, the gate selectably directs odd numbered sheets toward the first inverting path and selectably directs even numbered sheets toward the second inverting path.

While the first sheet of the sequentially spaced apart printed sheets is directed toward the first inverting path, the controller implementing the process 600 operates an actuator to rotate a roller that is in circumferential contact with two opposed idler rollers in a first direction (block 604). The rotation of the roller in the first direction directs the first sheet into a first nip in the first inverting path. The actuator in one embodiment is operated to rotate the roller in the first direction at the process speed of the printer before the first sheet arrives at the first nip to enable non-abusive transfer of the first sheet from the output path to the first nip.

As the first sheet of the sequentially spaced apart printed sheets is drawn through the first nip, the controller implementing the process 600 operates the actuator to rotate the roller in a second direction opposite the first direction (block 606). The rotation of the roller in the second direction directs the first sheet from the first nip and into the first inverting path. The actuator is preferably operated to rotate the roller in the second direction at the process speed before the first sheet arrives at a sheet feed mechanism of the first inverting path to enable non-abusive transfer of the first sheet from the first nip to the sheet feed mechanism.

Near in time with the change in roller direction from the first direction to the second direction (block 606), the controller determines if more sequentially spaced apart printed sheets are to be inverted (block 608). If no additional sequential sheets are to be inverted, the process ends after the first sheet is moved through the first inverting path (block 610).

If at least one additional sequentially spaced apart printed sheet is to be inverted, the controller configured to implement the process 600 selectably directs a second sheet of the sequential sheets from the output path toward the second inverting path (block $\mathbf{612}_1$). The rotation of the roller in the second direction directs the first sheet from the first nip and into the first inverting path and simultaneously directs the second sheet into a second nip in the second inverting path. The actuator is preferably operated to rotate the roller in the second direction at the process speed of the printer before the second sheet arrives at the second nip to enable non-abusive transfer of the second sheet from the output path to the second nip. Similarly, the actuator is preferably operated to rotate the roller in the second direction at the process speed before the first sheet arrives at the sheet feed mechanism of the first inverting path to enable non-abusive transfer of the first sheet from the first nip to the sheet feed mechanism.

As the second sheet is drawn through the second nip and the first sheet is driven out along the first inverting path, the controller implementing the process 600 operates the actuator to again rotate the roller in the first direction (block $\mathbf{614}_1$). The rotation of the roller in the first direction directs the second sheet from the second nip and into the second inverting path. The actuator is preferably operated to rotate the roller in the first direction at the process speed before the second sheet arrives at a sheet feed mechanism of the second inverting path to enable non-abusive transfer of the second sheet from the second nip to the sheet feed mechanism.

Near in time with the change in roller direction from the second direction to the first direction ($\mathbf{614}_1$), the controller determines if more sequentially spaced apart printed sheets are to be inverted (block $\mathbf{616}_1$). If no additional sequential sheets are to be inverted, the process ends after the second sheet is moved through the second inverting path (block $\mathbf{618}_1$).

If at least one additional sequentially spaced apart printed sheet is to be inverted, the controller configured to implement the process 600 inverts the at least one additional sequentially spaced printed sheet by repeating blocks $\mathbf{612}_x$-$\mathbf{616}_x$. For subsequent sequential sheet inversion, the sheet sequence identifiers, i.e., the "first sheet" and the "second sheet," associated with blocks $\mathbf{612}_1$-$\mathbf{616}_1$ are simplified to "new sheet" and "prior sheet" as described below. In addition, the nip identifiers, i.e., the "first nip" and the "second nip," the inverter identifiers, i.e., the "first inverting path" and the "second inverting path", and the roller directions, i.e., the "first direction" and the "second direction," are alternated for each successive sheet inversion performed by repeating blocks $\mathbf{612}_x$-$\mathbf{616}_x$.

For example, if at least one additional sequentially spaced apart printed sheet is to be inverted after the second sheet (block $\mathbf{616}_1$), the controller configured to implement the process 600 selectably directs a new sheet of the sequentially spaced apart printed sheets from the output path toward the first inverting path (block $\mathbf{612}_2$). The rotation of the roller in the first direction ($\mathbf{614}_1$) directs a prior sheet of the sequentially spaced apart printed sheets, i.e., the second sheet in this iteration, from the second nip and into the second inverting path and simultaneously directs the new sheet into the first nip in the first inverting path. As used herein, a "new sheet" is a sheet of the sequentially spaced apart printed sheets that is next in sequence to enter the inverter. A "prior sheet" is a sheet of the sequentially spaced apart printed sheets that enters the inverter immediately before a new sheet is directed into the inverter.

As the new sheet is drawn through the first nip and the prior sheet is driven out along the second inverting path, the controller implementing the process 600 operates the actuator to again rotate the roller in the second direction (block $\mathbf{614}_2$). The rotation of the roller in the second direction directs the new sheet from the first nip and into the first inverting path. Near in time with the change in roller direction from the first direction to the second direction (block $\mathbf{614}_2$), the controller determines if more sequentially spaced apart printed sheets are to be inverted (block $\mathbf{616}_2$). If no additional sequential sheets are to be inverted, the process ends after the new sheet is moved through the first inverting path (block $\mathbf{618}_2$). Subsequent sequential sheets are inverted using the process 600 as described above.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. An inverter comprising:

separate inverting paths including at least a first inverting path and a second inverting path;

a first idler roller;

a second idler roller;

a roller positioned between the first idler roller and the second idler roller to form a first nip between the roller and the first idler roller and to form a second nip between the roller and the second idler roller;

a gate being configured to direct sequentially spaced apart printed sheets to the first and second nips in alternating sequence; and an actuator operatively connected to the roller, the actuator being configured to:

rotate the roller in a first direction to direct a first sheet of the sequentially spaced apart printed sheets received from the gate into the first nip; and rotate the roller in a second direction opposite the first direction to direct the first sheet from the first nip and into a first inverting path and to simultaneously direct a second sheet of the sequentially spaced apart printed sheets received from the gate into the second nip.

2. The inverter of claim 1 wherein the sequentially spaced apart printed sheets enter the inverting paths at a process speed and the roller rotates at the process speed before the sequentially spaced apart printed sheets enter either of the first and second nips.

3. The inverter of claim 1 wherein the first and second inverter paths converge to a single path downstream from the roller.

4. The inverter of claim 1 wherein the gate is configured to direct the sequentially spaced sheets to only one of the first and second inverting paths.

5. The inverter of claim 1 wherein each of the first and second inverting paths includes a reversing portion and a discharge portion, the reversing portion being disposed in an area behind the respective first and second nips into which the sequentially spaced apart printed sheets are directed, the discharge portion being disposed in an area in front of the respective first and second nips through which the sequentially spaced apart printed sheets are directed to one of the inverting paths.

6. The inverter of claim 5 further comprising:

a bypass path proximate to and cooperative with the reversing portion of each of the first and second inverting paths, the bypass path enabling the sequentially spaced apart printed sheets to bypass the first and second inverting paths.

7. A method of inverting sheets in a printing apparatus comprising:

moving sequentially spaced apart printed sheets along an output path;

selectably directing selected sheets of the sequentially spaced apart printed sheets from the output path into one of a first inverting path and a second inverting path;

operating an actuator to rotate a roller that is in circumferential contact with two opposed idler rollers, the roller and one of the idler rollers forming a first nip in the first inverting path and the roller and the other idler roller forming a second nip in the second inverting path;

rotating the roller in a first direction to direct a first sheet of the sequentially spaced apart sheets through the first nip; and rotating the roller in a second direction opposite the first direction to direct the first sheet from the first nip and into the first inverting path and to simultaneously direct a second sheet of the sequentially spaced apart printed sheets into the second nip.

8. The method of claim 7 further comprising:

rotating the roller in the first direction to direct the second sheet from the second nip into the second inverting path and to simultaneously direct a third sheet of the sequentially spaced apart printed sheets into the first nip.

9. The method of claim 8 wherein the rotation of the roller between the first and second directions is repeated to direct a new sequentially spaced apart printed sheet into one of the first and the second nips and to direct a prior sequentially spaced apart printed sheet into one of the first inverting path and the second inverting path.

10. The method of claim 9 wherein the rotation of the roller between the first and second directions is repeated every 240 ms.

11. The method of claim 9 wherein the sequentially spaced apart printed sheets are moved along the output path at a process speed and the roller is rotated at the process speed before the sequentially spaced apart printed sheets enter either of the first and second nips.

12. The method of claim 11 wherein the process speed is approximately 1060 mm/s.

13. The method of claim 7 wherein the gate selectively directs the sequentially spaced apart printed sheets to only one of the first and second inverting paths.

14. The method of claim 7 wherein the gate selectably directs odd numbered sheets to the first nip and selectably directs even numbered sheets to the second nip.

15. The method of claim 7 wherein the sequentially spaced apart printed sheets move along the output path with an inter sheet gap, which is approximately 38.4 mm.

16. A printing apparatus comprising:

a first idler roller;

a second idler roller;

a roller positioned between the first idler roller and the second idler roller to form a first nip between the roller and the first idler roller and to form a second nip between the roller and the second idler roller;

a gate being configured to direct sequentially spaced apart printed sheets to the first and second nips in alternating sequence;

an actuator operatively connected to the roller, the actuator being configured to rotate the roller to direct the sequentially spaced apart printed sheets into and out of, respectively, each of the first and second nips; and a controller operatively connected to the actuator, the controller being configured to:

operate the actuator to rotate the roller in a first direction to direct a first sheet of the sequentially spaced apart sheets into the first nip; and operate the actuator to rotate the roller in a second direction opposite the first direction to direct the first sheet out of the first nip and into a first inverting path and to simultaneously direct a second sheet of the sequentially spaced apart printed sheets into the second nip.

17. The printing apparatus of claim 16, the controller being further configured to:

operate the actuator to rotate the roller in the first direction to direct the second sheet from the second nip into a second inverting path and to simultaneously direct a third sheet of the sequentially spaced apart printed sheets into the first nip.

18. The printing apparatus of claim 17, the controller being further configured to:

repeat the operation of the actuator to alternatingly rotate the roller in the first and second directions to direct a new sequentially spaced apart printed sheet into one of the first and the second nips and to direct a prior sequentially spaced apart printed sheet from the other of the first and the second nips into one of the first and the second inverting paths.

* * * * *